United States Patent [19]

Rider, Jr. et al.

[11] 4,241,970

[45] Dec. 30, 1980

[54] ELECTRICAL CONNECTOR HAVING IMPROVED RECEPTACLE TERMINAL

[75] Inventors: Clarence N. Rider, Jr., New Cumberland; William J. Rudy, Jr., Annville, both of Pa.

[73] Assignee: AMP Incorporated, Harrisburg, Pa.

[21] Appl. No.: 28,422

[22] Filed: Apr. 9, 1979

[51] Int. Cl.[3] ..... H01R 11/12

[52] U.S. Cl. ..... 339/99 R; 339/258 R

[58] Field of Search ..... 339/99, 258, 256, 47 R, 339/97, 98, 221 R, 221 M, 217 S, 255 R, 255 P, 259 R, 259 F, 278, 17 F, 176 MF

[56] References Cited

U.S. PATENT DOCUMENTS

| | | | |
|---|---|---|---|
| Re. 26,692 | 10/1969 | Ruehlemann | 339/176 |
| 3,162,501 | 12/1964 | Wahl | 339/98 |
| 3,199,066 | 8/1965 | Eledge | 339/176 |
| 3,221,289 | 11/1965 | Eads | 339/176 |
| 3,231,848 | 1/1966 | Ruehlemann | 339/176 |
| 3,233,208 | 2/1966 | Ruehlemann et al. | 339/176 |
| 3,354,424 | 11/1967 | Ruehlemann | 339/256 R X |
| 3,408,616 | 10/1968 | Greenbaum | 339/99 R |
| 3,414,865 | 12/1968 | Olsson | 339/47 |
| 3,820,055 | 6/1974 | Huffnagle | 339/17 F |
| 3,879,099 | 4/1975 | Shaffer | 339/99 R |
| 3,990,767 | 11/1976 | Narozny | 339/97 P X |
| 4,004,845 | 1/1977 | Sochor | 339/258 P |
| 4,062,616 | 11/1976 | Shaffer et al. | 339/99 R |
| 4,147,399 | 4/1979 | Moser | 339/99 R |
| 4,153,324 | 5/1979 | Kukla | 339/97 R |

FOREIGN PATENT DOCUMENTS

| | | | |
|---|---|---|---|
| 2455354 | 5/1975 | Fed. Rep. of Germany | 339/99 R |
| 2531252 | 1/1977 | Fed. Rep. of Germany | 339/258 R |
| 1461938 | 3/1967 | France | 339/258 R |

*Primary Examiner*—Neil Abrams
*Assistant Examiner*—John S. Brown
*Attorney, Agent, or Firm*—Russell J. Egan

[57] ABSTRACT

An improved electrical connector is disclosed having terminals with receptacle portions which provide greater contact area than with conventional terminals of a tuning fork design. The receptacle portion of the present terminal is formed by a pair of parallel spaced arms, each with a pair of tines inwardly directed towards the other of the arms. Each tine on each arm is bent from the plane defined by the arms in opposite directions with respect to the other tine of the pair and the tine on the opposite arm thereby presenting four tine surfaces defining the sidewalls of the receptacle portion of the terminal. The opposite end of each terminal is provided with a known configuration for engaging a conductor, for example, a slotted plate configuration providing insulation displacing termination of conductors. The terminals can also be profiled between the end portions to compensate for differences in spacing between the conductors to be terminated and the terminals to mate with. The connector itself has an overall improved design which results in a lower profile and economies of manufacture as well as the capability of being originally connected to a multi-conductor flat cable, in daisy chain fashion, as well as to subsequently add connectors intermediate the ends of a terminated cable.

10 Claims, 11 Drawing Figures

Fig. 8
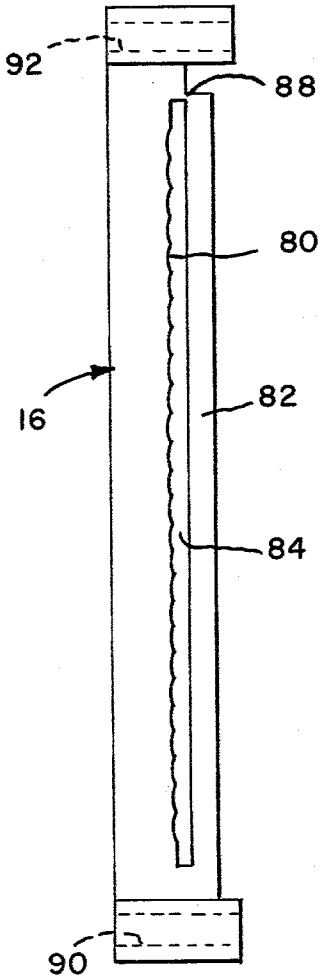
Fig. 9
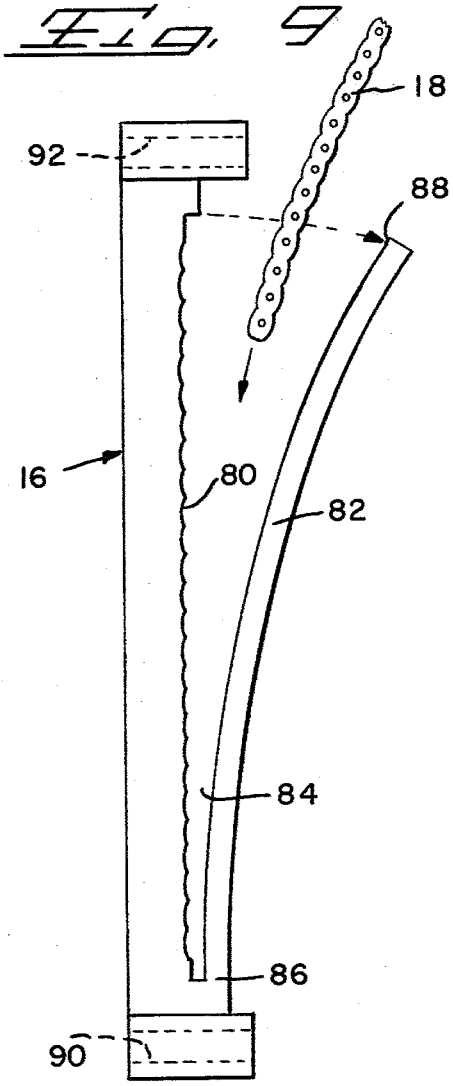
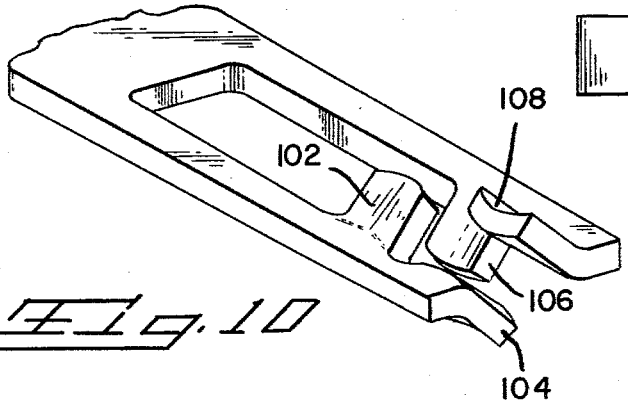
Fig. 10
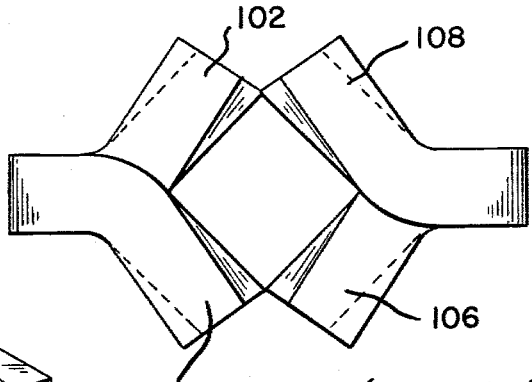
Fig. 11

ELECTRICAL CONNECTOR HAVING IMPROVED RECEPTACLE TERMINAL

BACKGROUND OF THE INVENTION

1. The Field of the Invention

The present invention relates to an electrical connector and in particular to an improved socket portion of a terminal to be used in such electrical connector.

2. The Prior Art

Electrical terminals of the tuning fork type configuration have had a certain number of inherent problems. For example, the terminal disclosed in U.S. Pat. No. 3,414,865 discloses a terminal which is stamped such that the tooling shears partly through the metal stock with the remainder being broken forming an irregular and rough edge. When such a terminal is used in an edgewise configuration, the roughened edge gouges into the mating surface, often with undesirable consequences. Such a terminal would be particularly unsuitable for use with plated surfaces since it would destroy the plating.

There have been attempts to overcome the above described difficulties by forming terminals in such a manner that they would mate with their surfaces rather than with edge portions. Examples may be found in U.S. Pat. Nos. 3,231,848; 3,233,208; and Re 26,692. The problem encountered with these terminals is they are quite expensive to produce because of the large number of stamping steps necessary to create the desired configuration and they are rather large and bulky terminals. It should be noted from each of the patents cited above that the terminals are of sufficient size that they are used for mating interconnection with printed circuit boards.

A further problem encountered in known electrical connectors is one of spacing. First there is the problem of interconnecting conductors that are on a first spacing with terminals of a second different spacing and then there is the dimensional problem of the overall size of the connector itself. Examples of connectors which have terminals configured to accommodate different spacings may be found in U.S. Pat. Nos. 3,879,099; 3,990,767; and 4,062,616. In each of these patents the terminal is bent in the plane of the metal stock to accommodate the spacing variance.

SUMMARY OF THE INVENTION

The subject electrical connector has an overall configuration and an improved terminal which allows for reduction in the dimensions of the connector as well as for interconnecting terminals on a first spacing with conductors on a second different spacing. The terminal of the connector has an improved receptacle portion defined by a pair of parallel spaced arms, each with a pair of inwardly directed tines with each tine being bent from the plane defined by the arms in a direction opposite that of the other of said pair of tines as well as with respect to the opposite tine. The tines thus form, with their inwardly directed surfaces, sidewalls of a substantially rectangular receptacle. The opposite end of each terminal is formed with a known conductor engaging configuration, such as an insulation displacing slotted plate. The terminals are preferably stamped and formed from a common strip of conductive material and have intermediate portions so angled as to achieve the desired spacing between adjacent terminals at each end of the terminals. The connector housing has a mating member with a mating face having a plurality of terminal passages opening therein and extending to a rear portion. The connector also includes a cable carrying cover mating with the rear portion of the connector. The cover has a cable receiving slot, one side of which is formed by a profiled surface of the cover and the other side by a plate attached at one end to the cover by a frangible section so that the plate can be opened to receive a cable that cannot otherwise be inserted through the slot. The cover also includes means for receiving latching portions of the mating member to secure the cover thereon.

It is therefore an object of the present invention to produce an improved electrical connector which has an overall lowered profile and which can be used for daisy chaining a cable harness with intermediate connectors being attached either initially or subsequent to the formation of the harness.

It is another object of the present invention to produce an improved electrical connector of reduced overall dimensions which can be used to terminate conductors on a first center line spacing and mate with terminals on a second center line spacing.

It is still another object of the present invention to produce an improved electrical terminal having a receptacle portion which provides improved surface contact with less material and forming step requirements than for previous tuning fork style terminals.

It is a further object of the present invention to produce an improved receptacle portion of an electrical terminal from a tuning fork configuration formed by a pair of parallel spaced arms each having inwardly directed tines with the adjacent tines of each arm bent in opposite directions from the plane defined by the arms and in the direction opposite the opposing tine on the other arm so that the inwardly directed surfaces of the tines define therebetween a substantially rectangular receptacle.

It is a still further object of the present invention to produce an improved electrical connector and terminal which can be readily and economically manufactured.

The foregoing objects and other advantages of the present invention will become apparent to those skilled in the art from the following detailed description taken with reference to the accompanying drawings.

BRIEF DESCRIPTION OF THE DRAWINGS

FIG. 8 is a side elevation of the cover portion of the connector housing;

FIG. 9 is a view, similar to FIG. 8, showing the cover plate opened to receive a cable intermediate the ends thereof;

FIG. 10 is a perspective view, similar to FIG. 4, showing an alternate embodiment of the receptacle portion; and FIG. 11 is an end view, similar to FIG. 6, showing the alternate receptacle portion according to FIG. 10.

DETAILED DESCRIPTION OF THE PREFERRED EMBODIMENT

Figure 1:
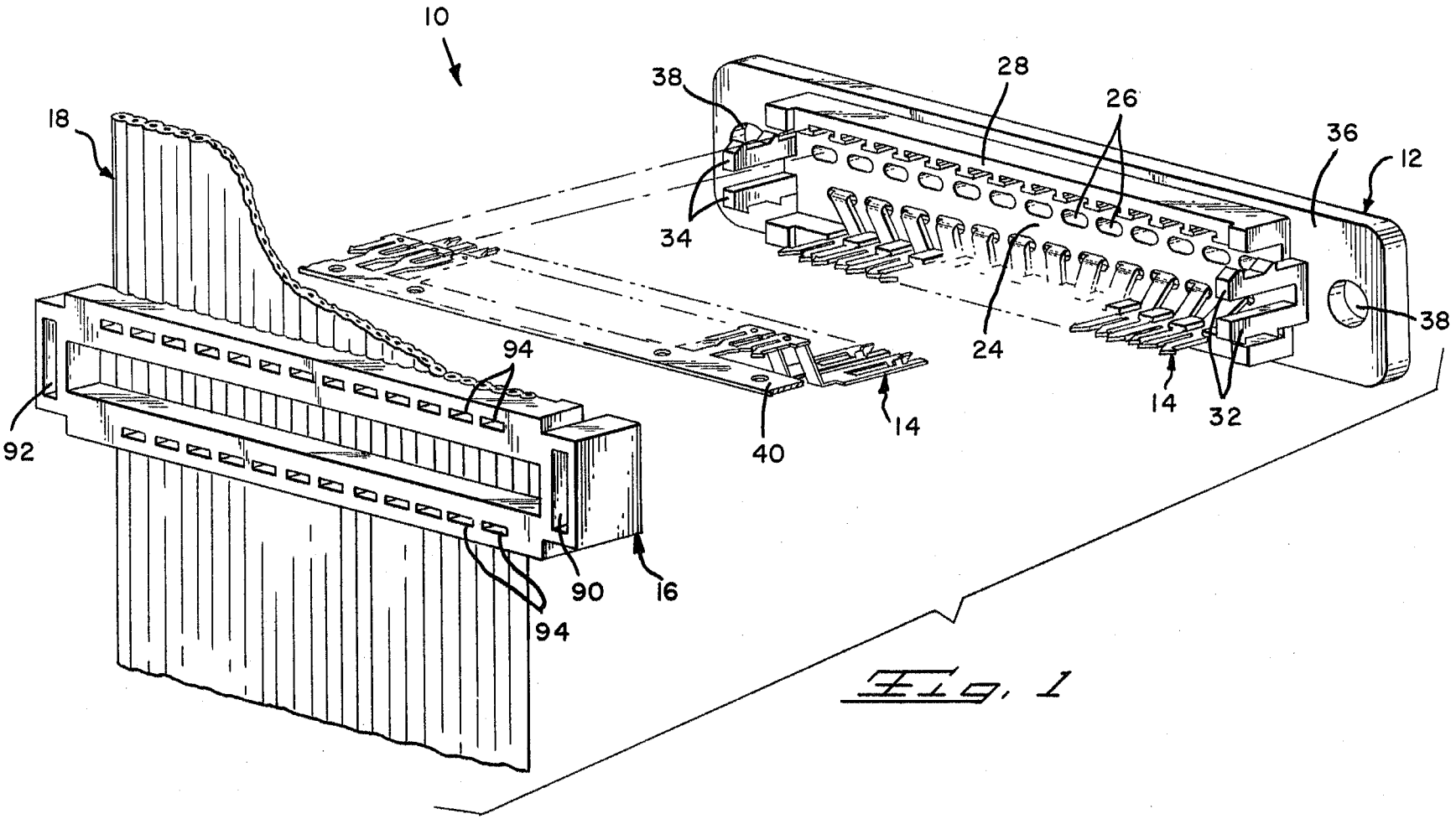
FIG. 1 is an exploded perspective view of the subject electrical connector and terminal according to the present invention.

The subject connector 10 includes a connector housing 12, a plurality of terminals 14, and a cover 16, and is adapted for terminating the conductors of a cable 18 and connecting them to an array of terminal pins 20. The housing 12 has a mating face 22, a rear face 24, and a plurality of passages 26 extending between the faces. The rear face is profiled by spaced sidewalls 28 defining an elongated cavity 30 with latch projections 32, 34 at each end thereof. The housing is completed by a peripherial flange 36 having mounting apertures 38 in the opposite ends thereof.

Figure 6:
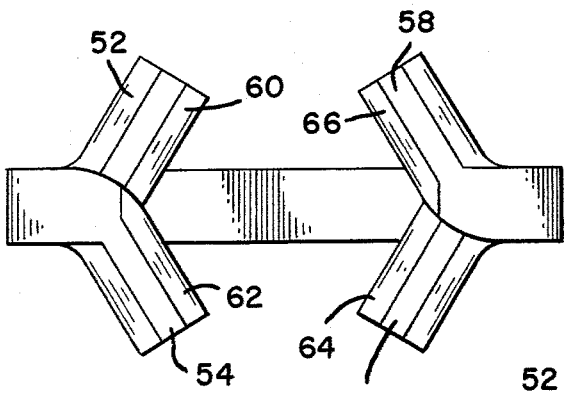
FIG. 6 is an end view of the receptacle portion of the terminal of FIGS. 4 and 5.

The terminals 14 are stamped and formed from a continuous web of metal stock and have a carrier strip 40 initially attached to one end thereof. The terminal body 42 (FIG. 4) has a receptacle portion 44 extending from one end thereof and a conductor engaging portion 46 extending from the opposite end thereof. The receptacle portion is defined by a pair of parallel spaced arms 48, 50 each with a pair of inwardly directed tines 52, 54, 56, 58, respectively. The tines are bent from the plane defined by the arms 48, 50 with the adjacent tines of each pair being bent in opposite directions to each other and to the opposed tine of the opposite arm so that the inwardly directed surfaces thereof define sidewalls of a substantially rectangular receptacle, as can best be seen in FIGS. 6 and 7. At least the leading edges of each tine can be provided with a chamfer 60, 62, 64, 66, respectively to assist lead in of a mating terminal pin 20. The opposite end of the terminal has a conductor engaging portion 46 which has been illustrated as a pair of tines 68, 70 defining therebetween a conductor engaging slot 72. On the free end of each tine there is an outwardly directed shoulder 74, 76, respectively. The terminal can also include a latch tine or projection 78 to aid in holding the terminal in the housing.

The cover 16 has a main portion with a profiled cable engaging surface 80 with a panel 82 spaced from the surface 80 to define a cable slot 85 therebetween. The panel 82 is permanently hingedly attached to the cover at one end 86 and attached by a frangible web 88 at the opposite end. The cover 16 also has latch receiving slots 90, 92 at the opposite ends thereof aligned to receive the latch projections 32, 34 of the housing, respectively. The cover 16 also has a plurality of terminal slots 94 aligned to receive a respective conductor engaging portion 46 of a terminal aligned in the housing 12. Each terminal slot 94 has a shoulder 96 which is engaged by the shoulders 74, 76 of the respective terminals to assist in latching the cover 16 to the connector housing 12.

Figure 2:
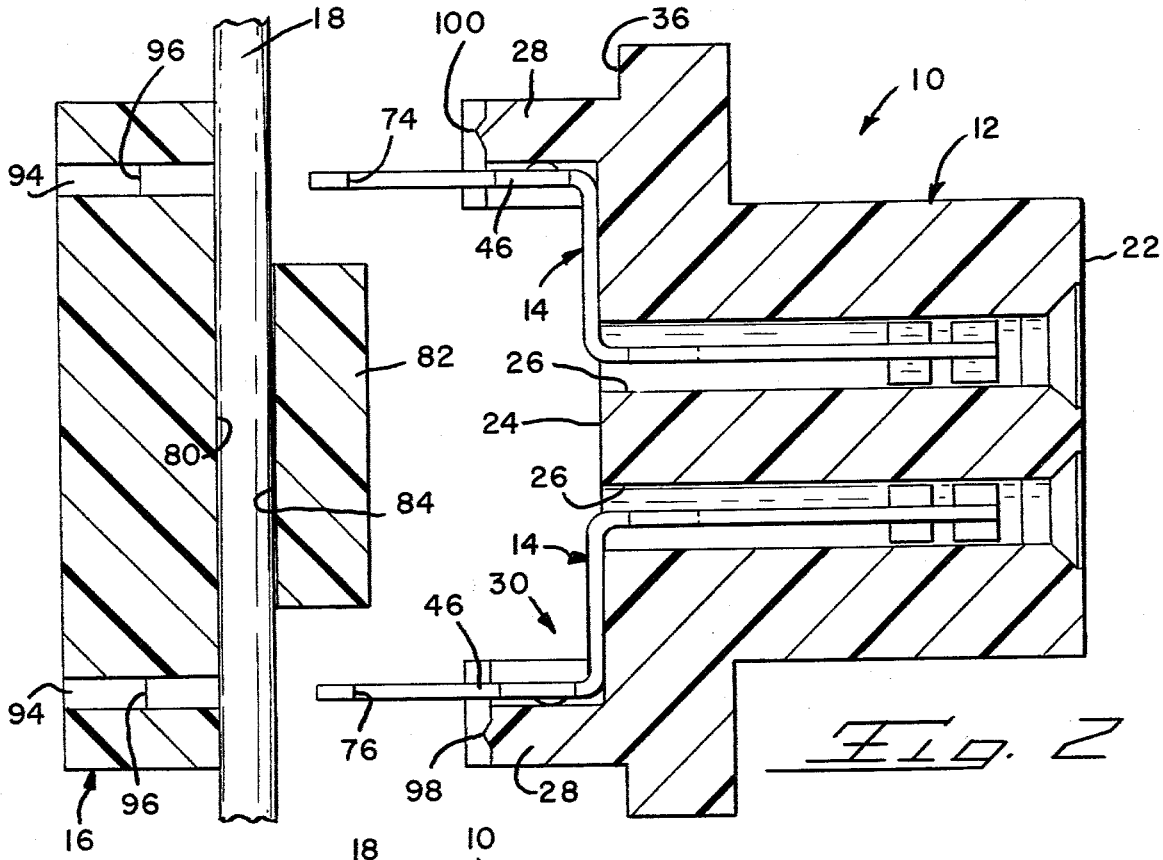
FIG. 2 is a transverse section through the connector of the present invention with the cover exploded therefrom.
Figure 3:
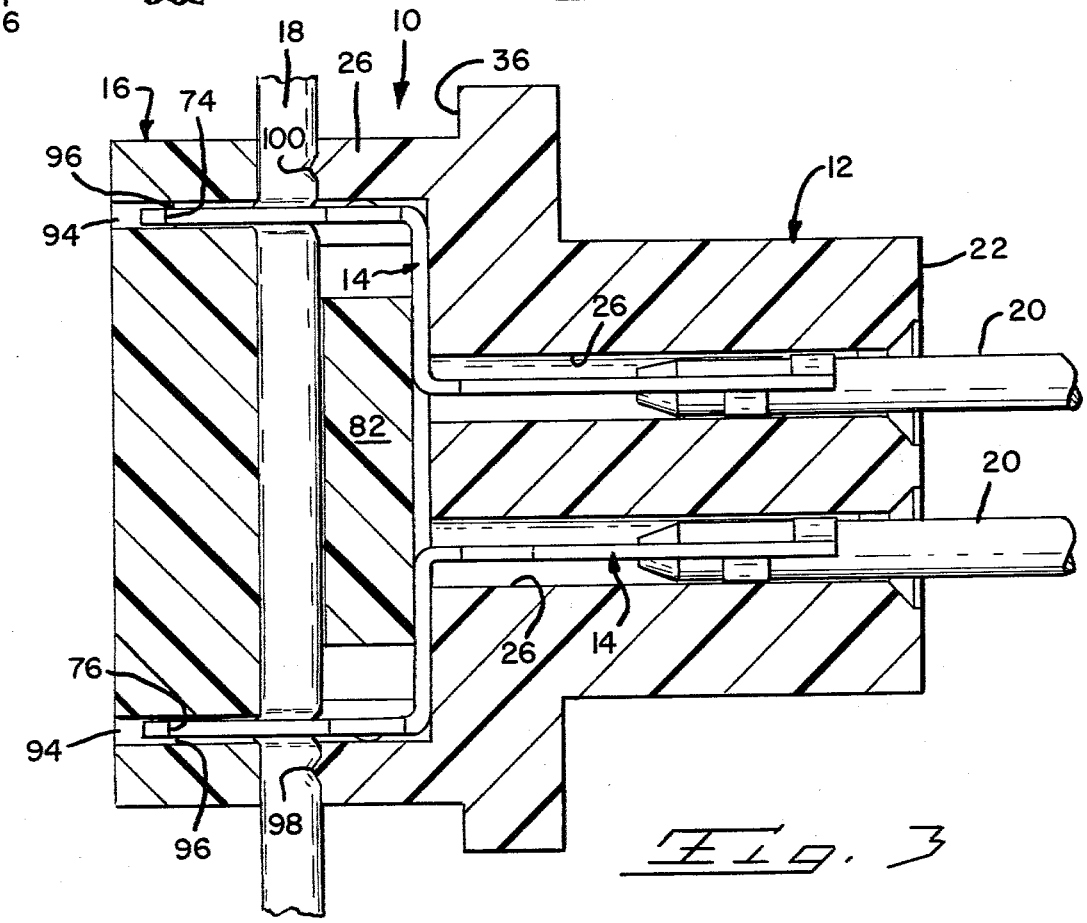
FIG. 3 is a transverse section, similar to FIG. 2, showing the connector in the fully assembled condition.

The terminals 14 are preferably formed in a continuous strip with a suitable configuration to be gang loaded into the connector housing, as shown in FIG. 1. The carrier strip 40 would be removed from the individual terminals 14 after the loading operation. The subject connector would be used to terminate a cable 18 by first slipping the end of the cable through the slot 84 in cover 16. The profiled surface 80 would aid in appropriately aligning the conductors of the cable with the respective terminals 14. The cover would then be applied to the housing 12, as shown in FIGS. 2 and 3, with the panel 82 pressing against the body 42 of the respective terminals to aid in securing them in the housing and preventing the rearward extraction thereof when a mating pin 20 is forced into the receptacle portion. When the cover 16 is fully in place, the individual terminals 14 will grip the cover by engagement of the shoulders 74, 76 of the terminals 14 with the shoulders 96 of the cover 16 as well as engagement of the latch projections 32, 34 of the housing 12 in the respective slots 90, 92 of the cover 16. It will also be noted, from FIGS. 3 and 4, that the housing 16 has transverse projections 98, 100 which will bitingly engage in the insulation of the cable 18 and act as a strain relief therefore.

Figure 4:
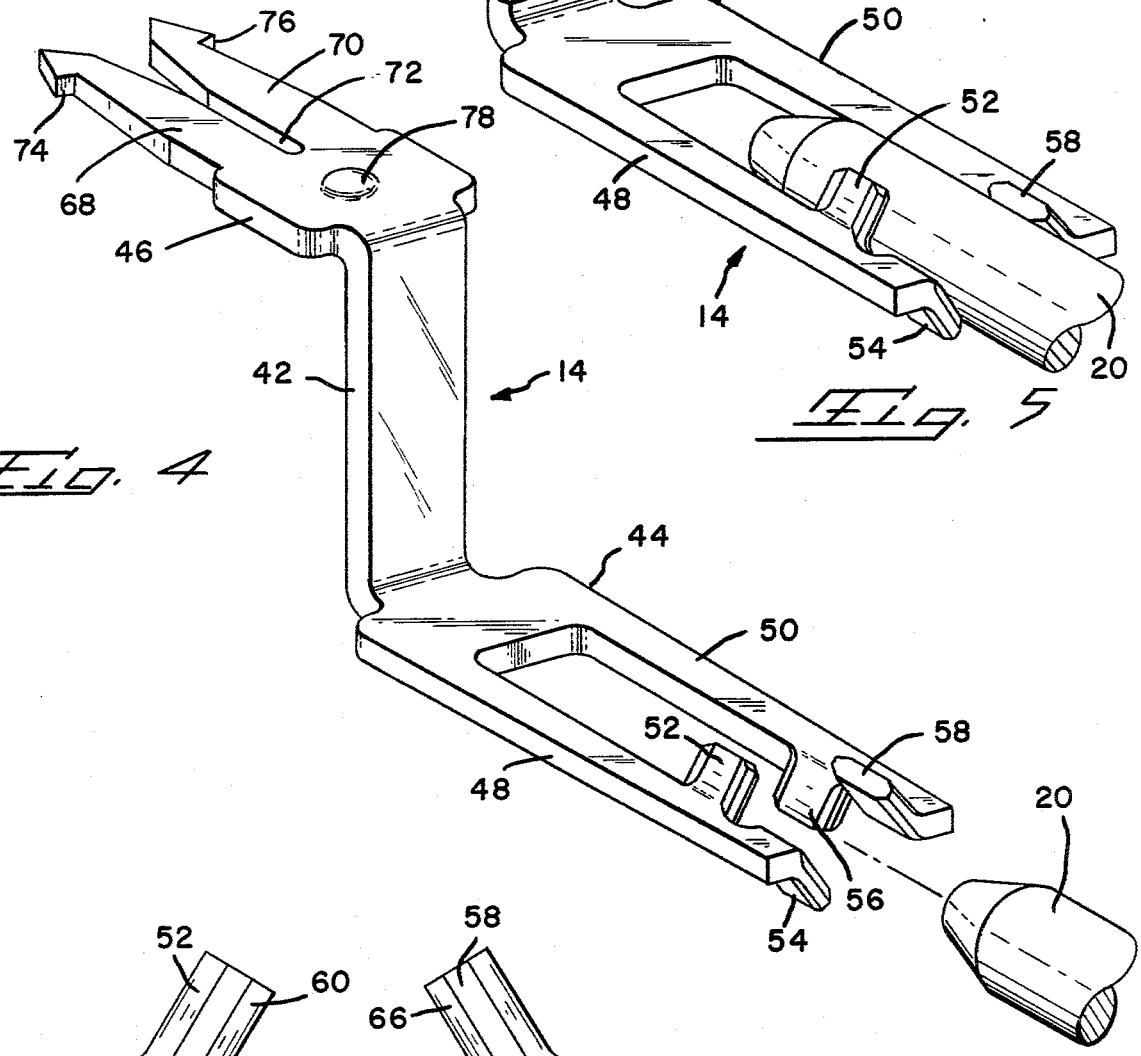
FIG. 4 is a perspective view of a terminal of the present invention.
Figure 5:
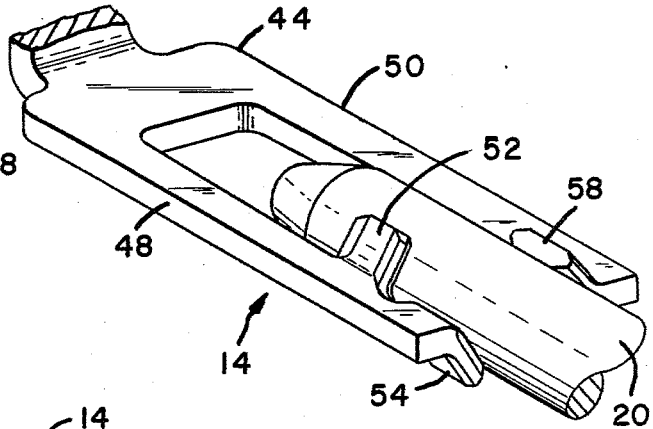
FIG. 5 is a perspective view of the receptacle portion of the terminal of FIG. 4 with a pin terminal received therein.
Figure 7:
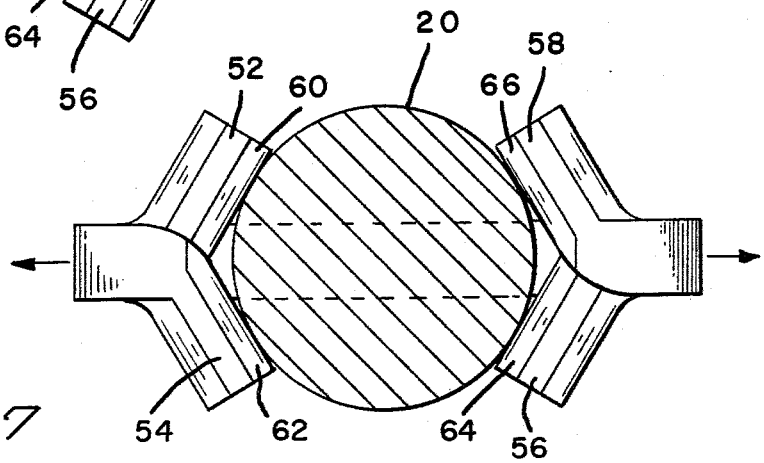
FIG. 7 is an end view, similar to FIG. 6, showing a pin terminal received in the receptacle portion.

The assembled connector can receive terminal pins 20 in the receptacle portions as shown in FIGS. 4, 5, and 7. It will be noted from a comparison of FIGS. 6 and 7 that the arms 48, 50 will deflect outwardly upon insertion of a pin 20 therebetween thus assuring good contact forces being applied. It will also be noted from FIG. 7 that the surfaces of the respective tines 52, 54, 56, 58 make a tangential contact with the surface of the round terminal pin 20.

In the event it is desired to use the subject connector to terminate a cable having connectors already fastened at the ends thereof, it is necessary then to break the frangible web 88 in order to open the panel 82 and allow the cable 18 to be placed in the slot 84. This is shown diagrammatically in FIG. 9. The rest of the assembly would follow in the previous manner.

An alternate embodiment of the receptacle portion is shown in FIGS. 10 and 11. In this embodiment the tines are formed with a bowed or arcuate section, thus eliminating the previous chamfer, and are bent at such an angle as to form a square receptacle as shown in FIG. 11. This receptacle could be used to mate with terminal pins having either a round or a square section.

The present invention may be subject to many modifications and changes without departing from the spirit or essential characteristics thereof. The described embodiments are therefore to be considered in all respects as illustrative and not restrictive of the scope of the invention.

What is claimed is:

1. An electrical connector for interconnecting conductors of a multi-conductor cable to an array of terminal pins, said connector comprising:

a housing of insulative material having a mating front face and a rear face, a plurality of terminal passages extending between said faces, and latch projections extending from said rear face;

a like plurality of terminals each being formed of electrically conductive material with a body portion engaging said rear face, a mating terminal engaging first end extending into a respective passage in said housing, and a conductor engaging second end extending rearwardly from said rear face, said mating terminal engaging first end having a pair of parallel spaced arms each with at least one pair of tines directed toward the other of said arms, each tine of each pair being bent, with respect to the plane defined by said arms, in a direction opposite that of the other of said pair of tines and the opposing tine on the other of said arms, and said conductor engaging second end having a pair of tines defining a conductor engaging slot therebetween, each said tine having an insulation piercing profile on the free end thereof; and a cover adapted to mate against said rear face, said cover having a cable slot extending therethrough in a first direction, latch slots extending through said cover in a second direction normal to said first direction and aligned to receive said latch projections therein, and terminal passages extending through said cover in said second direction and intersecting said cable slot whereby conductors of a cable positioned in said cable slot are terminated by said conductor engaging second ends of said terminals and mated with an array of pin terminals by said mating terminal engaging first ends.

2. An electrical connector according to claim 1 wherein said housing further comprises:

a pair of parallel, spaced profiled walls extending from said rear face and enclosing said terminal passages, said terminals being held in position within said housing by the profiled walls.

3. An electrical connector according to claim 2 further comprising:

cable strain relief projections on the free edge of each said wall cooperating with said cover to provide strain relief for a cable terminated by said connector.

4. An electrical connector according to claim 1 wherein each said latch projections comprises:

a pair of spaced arm members each having at least two outwardly directed projections whereby said cover is selectively secured to said housing in either a first spaced condition or a second mated condition.

5. An electrical connector according to claim 1 wherein said housing further comprises:

an integral peripherial flange having at least one mounting aperture therein.

6. An electrical connector according to claim 1 further comprising:

latch means on each said terminal adapted to secure each said terminal in said housing.

7. An electrical connector according to claim 1 further comprising:

outwardly directed latch shoulders on the free end of each said tine.

8. An electrical connector according to claim 1 wherein the first and second ends of said terminal are offset with respect to each other by said body whereby said terminal interconnects conductors of a cable on a first centerline spacing with pin terminals on a second different centerline spacing.

9. An electrical connector according to claim 1 wherein said cable slot in said cover comprises:

a sidewall of said cover;

a plate hingedly attached at one end to said cover and attached at the other end by a frangible web to lie in a parallel spaced relationship to said sidewall, said plate and sidewall of said cover defining said cable slot therebetween.

10. An electrical connector according to claim 9 wherein at least one of the opposing faces of said sidewall and said plate are profiled by a series of conductor aligning grooves.

* * * * *